US006240390B1

(12) United States Patent
Jih

(10) Patent No.: US 6,240,390 B1
(45) Date of Patent: May 29, 2001

(54) MULTI-TASKING SPEECH SYNTHESIZER

(75) Inventor: Chaur-Wen Jih, Taoyuan Hsien (TW)

(73) Assignee: Winbond Electronics Corp. (TW)

( * ) Notice: Subject to any disclaimer, the term of this patent is extended or adjusted under 35 U.S.C. 154(b) by 0 days.

(21) Appl. No.: 09/137,958

(22) Filed: Aug. 21, 1998

(30) Foreign Application Priority Data

May 18, 1998 (TW) ..... 87107658

(51) Int. Cl.[7] ..... G10L 13/04
(52) U.S. Cl. ..... 704/267; 704/258
(58) Field of Search ..... 704/258, 267

(56) References Cited

U.S. PATENT DOCUMENTS

| | | | | |
|---|---|---|---|---|
| 4,940,965 | * | 7/1990 | Umehara | 340/460 |
| 5,016,006 | * | 5/1991 | Umehara | 340/984 |
| 5,045,993 | * | 9/1991 | Murakami et al. | 364/200 |
| 5,708,760 | * | 1/1998 | Hsiao et al. | 704/258 |
| 5,809,466 | * | 9/1998 | Hewitt et al. | 704/258 |
| 5,954,811 | * | 9/1999 | Garde | 712/35 |

OTHER PUBLICATIONS

Texas Instruments, Design Manual for TSP50COx/1x Family Speech Synthesizer, sec. 2.3, 1994.*

* cited by examiner

*Primary Examiner*—William R. Korzuch
*Assistant Examiner*—Tālivaldis Ivars Šmits
(74) *Attorney, Agent, or Firm*—Blakely Sokoloff Taylor & Zafman

(57) ABSTRACT

A speech synthesizer and a method of synthesizing speech are provided. The speech synthesizer includes a memory unit having an interrupt vector section, a voice list section, a control program section, and a speech data section; a voice list pointer for pointing to the address in the voice list section of the memory unit where data are to be retrieved; a start address register whose content represents the starting address of a specific segment of waveform data stored in the speech data section of the memory unit; a program counter whose output is used to gain access to specific addresses in the control program section of the memory unit; a synthesizer, coupled to the memory unit, for synthesizing the retrieved speech data from the memory unit into voice data; and an interrupt controller coupled to the synthesizer, which is capable of actuating the execution of an synthesis interrupt service routine stored in the memory unit in response to an interrupt signal generated by the synthesizer. The foregoing architecture for the speech synthesizer allows the speech synthesizer to be capable of driving external devices in a multi-tasking manner while nonetheless allowing the software complexity to be simple to implement. Moreover, the architecture and method of the speech synthesizer allows the voice concatenation to be easy to implement either through hardware or through software.

16 Claims, 4 Drawing Sheets

MULTI-TASKING SPEECH SYNTHESIZER

CROSS-REFERENCE TO RELATED APPLICATION

This application claims the priority benefit of Taiwan application serial no. 87107658, filed May 18, 1998, the non-essential material of which is incorporated herein by reference.

BACKGROUND OF THE INVENTION

1. Field of the Invention

This invention includes speech synthesizers, and more particularly, to an architecture for speech synthesizer and a method to synthesize speech, which allows the speech synthesizer to be capable of driving external devices in a multi-tasking manner while nonetheless allowing the software complexity and voice concatenation to be simple to implement.

2. Description of Related Art

A synthesizer may be a device that combines a variety of items so as to form a new, complex product. Speech synthesizers are widely utilized in various systems where voice is used to output certain messages or data to the user, such as personal computers, mobile phones, toys, and warning systems, to name a few. A speech synthesizer is typically provided with a ROM (read-only memory) unit which stores a database of various sounds or words that can be retrieved and combined to form a stream of voices of specific meanings. This ROM unit is typically partitioned into a number of sections, called speech sections. In one standard for voice synthesizing, such speech sections are designated by $H_4$, $S_1$, $S_2$, . . . , $S_n$. and $T_4$. Each speech section represents one of 250 basic phonic elements that can be selected and combined into the sound data of various words or phrases. Alternatively, each speech section can store the sound data of complete words. However, this is merely a design choice by the speech synthesizer designer.

The data in each speech section can be selected for synthesizing into words or phrases through various speech equations (EQ), each EQ representing the combination of a number of selected phonic elements that are combined in accordance with the EQ to form a particular word or phrase of a specified meaning. For example, $EQ=H_4+S_1+S_2+S_3+T_4$ may represent either a five-sound word or a five-word phrase.

The foregoing scheme of using phonic elements for the synthesizing of words allows the required memory space for the speech database to be significantly reduced as compared to the scheme of storing the sound of each word in the ROM unit. Moreover, it allows the designer to be more flexible and versatile in designing the speech synthesizer for the purpose of providing the sound data of more complex words or phrases.

One standard for speech synthesis defines one section of speech data as the combination of a number of bytes, respectively designated by $H_4$, $S_1$, $S_2$, $S_3$, and $T_4$. This scheme is illustratively depicted in FIG. 1. Each of the bytes ($H_4$, $S_1$, $S_2$, $S_3$, $T_4$) represents one basic constituent element of sound data and can be either a single sound, a series of sounds, a piece of music, or the combination of several pieces of music.

FIG. 2 is a schematic block diagram showing a conventional speech synthesizer, as designated by the reference numeral 10, that can be used for the synthesizing of the speech data shown in FIG. 1 into digital sound data. As shown, this speech synthesizer 10 includes a memory unit 11, such as a ROM unit, and a synthesizer 12. The ROM unit 11 is used to store a database of phonic elements and various other kinds of speech data that can be selectively retrieved for synthesizing into sound data of specific meanings. When the speech synthesizer 10 receives a trigger signal 14, the corresponding phonic elements in the ROM unit 11 are retrieved and then transferred to the synthesizer 12 for synthesizing into sound data. The synthesized sound data are then converted into audible sounds by a loudspeaker 13. One benefit of this speech synthesizer is that its system architecture is quite simple to implement.

One drawback to the foregoing speech synthesizer 10, however, is that it is only capable of outputting the synthesized speech data as audible sounds through the loudspeaker 13, but incapable of driving external devices such as motors or light-emitting diodes (LED) in a multi-tasking manner at the same time.

The synthesizer 12 utilized in the speech synthesizer 10 is typically included in a state machine that can perform some I/O controls. One drawback to the utilization of the speech synthesizer in state machine, however, is that the I/O ports thereof can be switched for other I/O functions only when at the break between two consecutive speech sections. Therefore, the architecture of FIG. 2 would not meet high quality requirements for speech synthesizers.

FIG. 3A is a schematic block diagram of a conventional speech synthesizer 20 with multi-tasking capability. As shown, this speech synthesizer 20 includes a memory unit 21 such as a ROM unit, a micro-controller 22, a synthesizer 23, and a digital-to-analog converter (DAC) 24. Moreover, the speech synthesizer 20 is coupled to a loudspeaker 25. The memory unit 21 is used to store a database of phonic elements and various other kinds of speech data that can be selectively retrieved for synthesizing into sound data of specific meanings. When the speech synthesizer 20 receives a trigger signal 27, the corresponding data are retrieved under control of the micro-controller 22 from the memory unit 21 and subsequently transferred to the synthesizer 23 for synthesizing into sound data of specific meanings. The digital output from the synthesizer 23 is then converted by the DAC 24 into analog form which is then converted by the loudspeaker 25 into audible form. The micro-controller 22 allows the speech synthesizer 20 to perform I/O functions with external devices such as motors or LEDs.

Alternatively, as shown in FIG. 3B, the micro-controller 22 and the synthesizer 23 in the speech synthesizer 20 of FIG. 3A can be replaced by a single microprocessor 26. With this architecture, both the I/O controls and the synthesizing of speech data are performed by the microprocessor 26.

The foregoing speech synthesizer with multi-tasking capability, however, still has a drawback in encoding. For example, the voice concatenation, which is a technique to combine a number of separate phonic elements into a continuous stream of meaningful sounds, would be very complex in algorithm that can be very difficult to code into software program. Therefore, the design of the speech synthesizer would be a very laborious and time-consuming job to carry out. The development period typically requires at least one month.

In conclusion, the prior art has the following drawbacks.

(1) First, in respect to the prior art of FIG. 2, although it is simple in system architecture that allows it easy to design, it is incapable of driving external devices such as motors and LEDs in a multi-tasking manner at the same time when performing the speech synthesis. Moreover, it cannot switch the output state of the I/O ports except at the break between two consecutive speech sections.

(2) Second, in respect to the prior art of FIGS. 3A–3B, its multi-tasking capability is complex in algorithm that would cause the programming to be very complex to implement. The development period is therefore quite long.

SUMMARY OF THE INVENTION

It is therefore an objective of the present invention to provide a speech synthesizer and a method of synthesizing speech, which is capable of driving external devices in a multi-tasking manner and which is simple in software complexity.

It is another objective of the present invention to provide a speech synthesizer and a method of synthesizing speech, which allows voice concatenation to be easy to implement either through hardware or through software.

In accordance with the foregoing and other objectives of the present invention, a new speech synthesizer and a method of synthesizing speech are provided.

The speech synthesizer of the invention includes a memory unit, a voice list pointer, a start address register, a program counter, a synthesizer and an interrupt controller.

The memory unit has an interrupt vector section, a voice list section, a control program section, and a speech data section. The value of voice list pointer represents an address in the voice list section of the memory unit for gaining access to the data stored in the specified address in the voice list section of the memory unit. The content of start address register represents the starting address of a specific chunk of waveform data stored in the speech data section of the memory unit. The output of the program counter is used to gain access to specific addresses in the control program section of the memory unit. The synthesizer, coupled to the memory unit, is used for synthesizing the retrieved speech data from the memory unit into voice data. The interrupt controller is coupled to the synthesizer, which is capable of actuating the execution of an synthesis interrupt service routine stored in the memory unit in response to an interrupt signal generated by the synthesizer.

The architecture of the speech synthesizer of the invention allows the speech synthesizer to be capable of performing multi-tasking on external devices and the outputting of the synthesized sound data. Moreover, it allows the speech synthesizer to be constructed with simple software complexity and can be realized by either hardware or software for voice concatenation.

Further, one embodiment of the method of the invention includes the following steps. From a first speech section, the address is fetched corresponding to a voice list pointer (VLP) VLP. A first segment of speech data first segment is retrieved from the first speech section. The retrieved speech data is synthesized into voice data and then the synthesized voice data is broadcasted. An interrupt signal is generated when the broadcasting of the synthesized voice data is completed. The VLP is incremented to gain access to the next speech section. The invention also determines whether a stop mark is encountered in the data retrieved from the current speech section. If no stop mark is encountered, the invention repeats from the step of where the retrieved speech data is synthesized into voice through the step of checking whether a stop mark is encountered in the data retrieved from the current speech section. If a stop mark is encountered, then the invention terminates the synthesizing operation.

The above-described method of the speech synthesizer of the invention allows the speech synthesizer to be capable of performing multi-tasking on external devices 28 and the outputting of the synthesized sound data. Moreover, it allows the speech synthesizer to be constructed with simple software complexity and can be realized by either hardware or software for voice concatenation.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENTS

Figure 1:
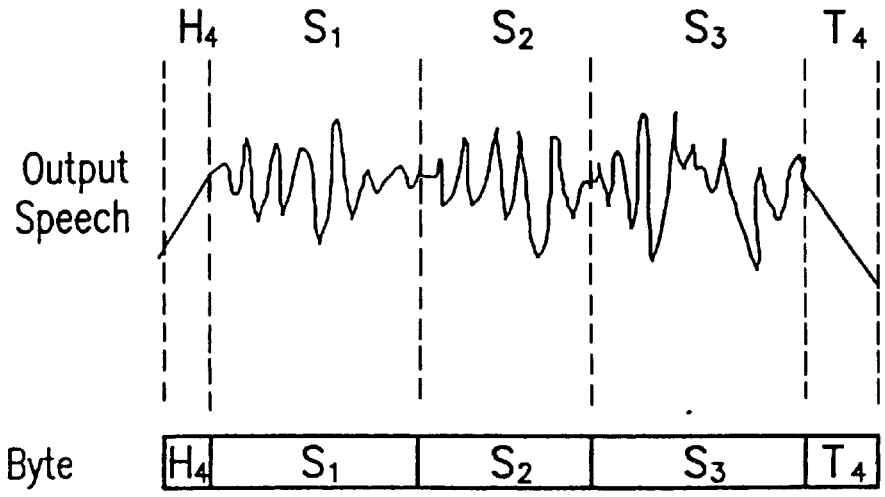
FIG. 1 (PRIOR ART)
FIG. 1 is a schematic diagram used to depict a present standard which defines the format for speech data and voice signal waveforms.
Figure 2:
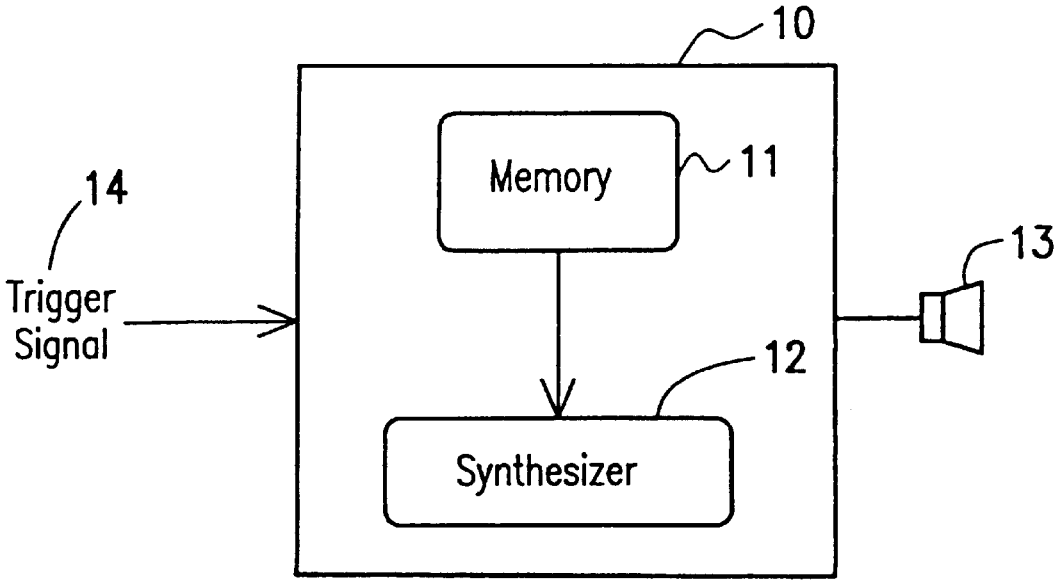
FIG. 2 (PRIOR ART)
FIG. 2 is a schematic block diagram of a conventional speech synthesizer.
Figure 3A:
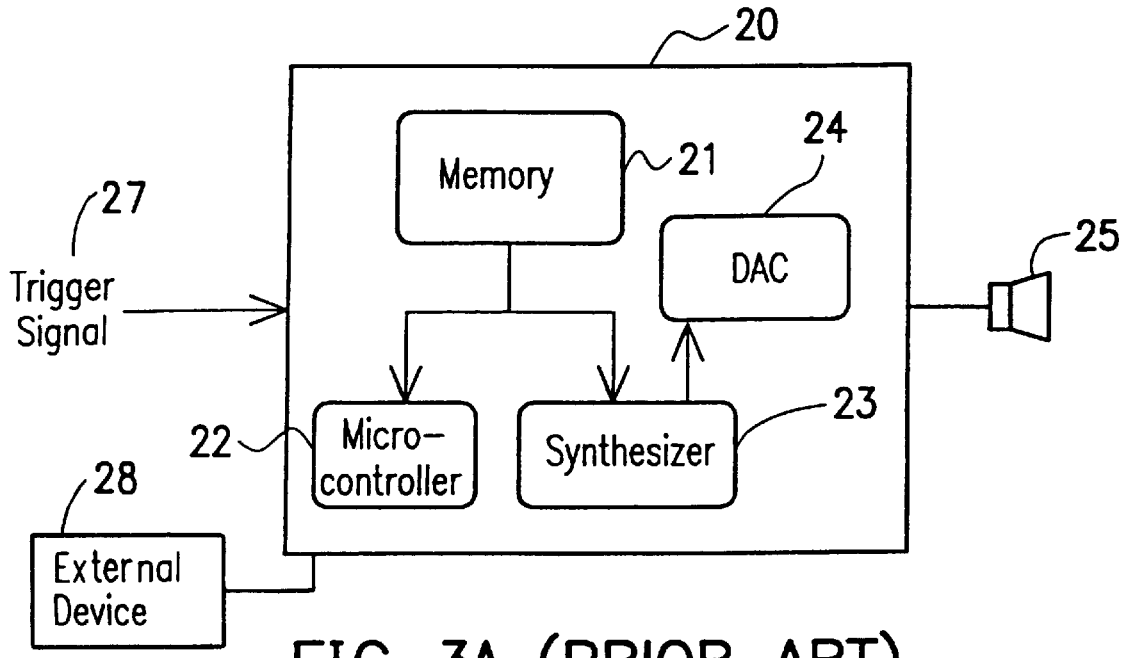
FIG. 3A (PRIOR ART)
FIG. 3A is a schematic block diagram of a first conventional speech synthesizer with multi-tasking capability.
Figure 3B:
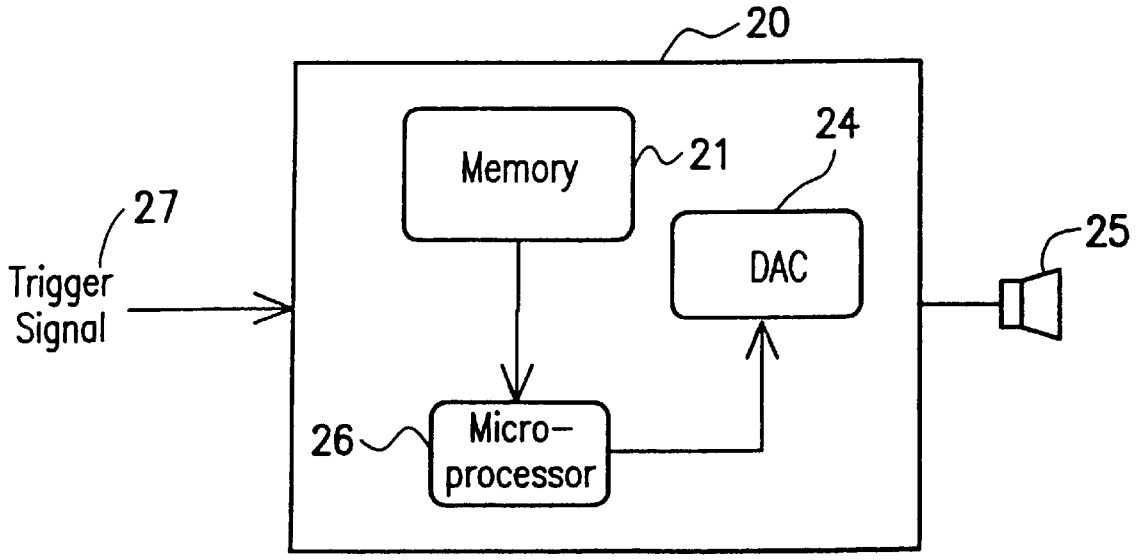
FIG. 3B (PRIOR ART)
FIG. 3B is a schematic block diagram of a second conventional speech synthesizer with multi-tasking capability.
Figure 4:
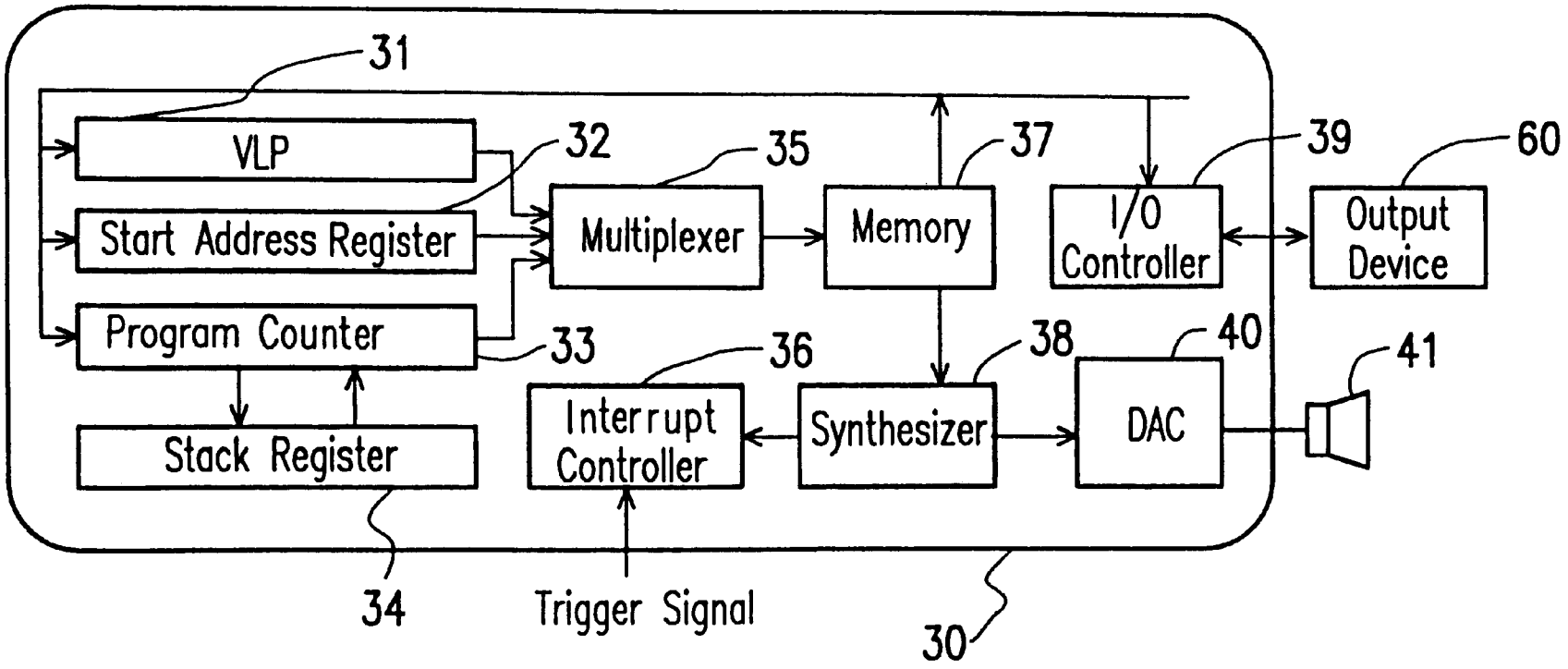
FIG. 4 is a schematic block diagram of the speech synthesizer according to the invention.

FIG. 4 is a schematic block diagram showing the architecture of the speech synthesizer according to the invention, which is designated by the reference numeral 30. As shown, the speech synthesizer 30 of the invention includes a voice list pointer (VLP) unit 31, a start address register 32, a program counter 33, a stack register 34, a multiplexer 35, an interrupt controller 36, a memory unit 37, a synthesizer 38, an input/output (I/O) controller 39, and a digital-to-analog converter (DAC) 40. Output device 60 is external to speech synthesizer 30. The output of the DAC 40 is coupled to a sound transducer 41, such as a loudspeaker, for converting into audible form.

Figure 5:
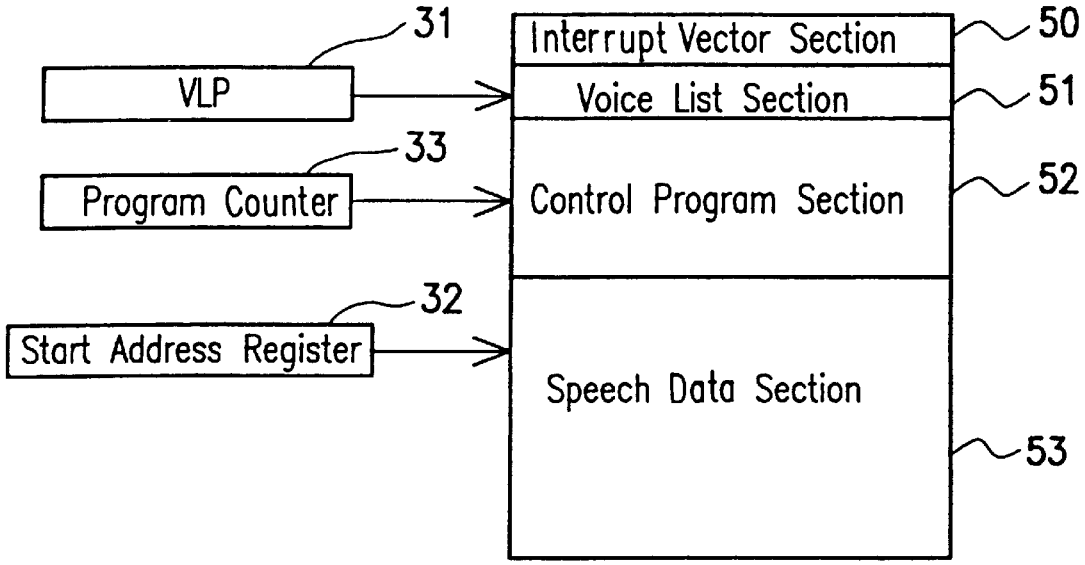
FIG. 5 is a schematic diagram used to depict the memory allocation in the memory unit in the speech synthesizer.

The memory unit 37 is, for example, a ROM (read-only memory), which is partitioned into a plurality of sections, including a first section 50 (FIG. 5) for storing a number of interrupt vectors branching to some interrupt routines including a synthesis interrupt service routine; a second section 51 for storing a voice list; a third section 52 for storing a control program that can be used for I/O controls; and a fourth section 53 for storing various speech data that can be retrieved in a predetermined manner for synthesizing into sound data that can be then reproduced.

The VLP 31 is used to point to the current speech section in the voice list section 51. The start address register 32 is used to store the address value indicative of the location in the speech data section 53 where the speech data corresponding to the pointed speech section in the voice list section 51 are stored. The program counter 33 is used to generate a sequence of consecutive address values used to gain access to the memory unit 37.

An example of speech synthesis by the speech synthesizer 30 is given in the following. At start, the program counter 33 is set to output a specified address value used to gain access to a selected location in the control program section 52. The instruction code stored in this location is then executed to assign the starting address of a segment of speech data to the VLP 31. After this, the output address value from the program counter 33 is incremented to fetch the next instruction from the control program section 52, which is then executed to read the data in the first speech section of the speech data. The corresponding speech data in the voice list section 51 are then retrieved in accordance with the VLP 31. The retrieved data from voice list selection 51 include the frequency of the voice and a pointer that is pointed to an address in the speech data section 53 where the associated waveform data are stored. The address of the associated waveform data is then put into the start address register 32. After this, the content of the VLP 31 is incremented to point to the next speech section.

The speech synthesizer 30 then retrieves the speech data stored in the speech data section 53 in accordance with the waveform data address stored in the start address register 32. The retrieved data are then transferred to the synthesizer 38 for synthesizing into speech voices.

One example of the instruction sequence is shown below:

LD VLP, addr ;fetches the address value currently pointed by VLP

RD VLP ;retrieve the data in the speech section currently pointed by VLP play ch ;synthesizing the retrieved speech data When the instruction "play ch" is being executed, the synthesizer 38 uses the data in the speech data section 53 stored in the memory unit 37 to reset and start the synthesizer 38 to synthesizing the retrieved speech data into sound data.

At the end of the retrieved data from the currently selected speech section, the synthesizer 38 will generate an interrupt signal to the interrupt controller 36, causing the interrupt controller 36 to execute an interrupt service routine. This causes the speech synthesizer 30 to enter into the interrupt mode, in which the program counter 33 is set to a specific address value that is pointed to an address in the interrupt vector section 50 where the corresponding interrupt vector is stored. The interrupt service routine fetches the data that are stored in the next speech section in the voice list section 51 that is currently pointed by the VLP 31. Meanwhile, the start address register 32 is set to the address of the associated waveform data of the next speech section. After this, the VLP 31 is incremented to gain access to the next instruction. The retrieved data are then transferred to the synthesizer 38 for synthesizing into sound data. After this is completed, the speech synthesizer 30 exits the interrupt mode and returns to the main program.

The foregoing process is repeated to retrieve data and synthesize the retrieved data into sound data. When a stop mark in the speech section is encountered, a stop signal will be generated to stop the operation of the synthesizer 38 and turn it into a standby state.

Since the synthesizing of the speech data into sound data is carried out through the interrupt service routine, it can operate repeatedly and incessantly. This feature allows the designer to fully utilize the main program for external I/O controls. The speech synthesizer of the invention can thus be simplified in software complexity while nonetheless capable of performing multi-tasking on external devices and the outputting of the synthesized sound data.

When the speech synthesizer of the invention is implemented through hardware, the compressed speech data from the memory unit 37 are first fed into the synthesizer 38 for synthesizing into sound data, and then the digital output of the synthesizer 38 is converted by the DAC 40 into analog form which can be then converted by the sound transducer 41 into audible form. The stack register 34 is used to store the return address of an interrupt/call operation. The multiplexer 35 is used to couple either the output of the VLP 31, the output of the start address register 32, or the output of the program counter 33, to the memory unit 37 so as to gain access to data stored in various locations in the memory unit 37 in accordance with current requests. The interrupt controller 36 is capable of interrupting the speech synthesizer 30 in response to an externally generated trigger signal 39 or an interrupt signal from the synthesizer 38. The synthesizer 38 is used to synthesize the retrieved speech data from the memory unit 37 through a PCM (pulse-code modulation) method into digital sound data. The I/O controller 39 is used for I/O controls of external devices (60) such as a motor (not shown) or an LED (not shown) in response to instructions from the memory unit 37.

In the foregoing speech synthesizer 30, the interrupt signal is generated through hardware means. Alternatively, it can be generated through software means.

One example of a software program designed for the speech synthesizer is shown below:

LD R0, 3

MOV R1, R2

ADD R3, R5 play ch, $H_4+S_1+S_2+S_3+S_4+S_5+T_4$

LD R6, F loop: (I/O control)

DINZ R6, loop

LD output, 0011B

NOP

LD output, 0011B

NOP

LD output, 0010B

. . .

RTI

Synth-INT (synthesis interrupt service routine)

RD VLP play ch

RTI

With the provision of the voice list section, the VLP 31, and the synthesis interrupt service routine, the voice concatenation can be carried out automatically by the hardware without having to devise complex software programs to perform this task. Therefore, the speech synthesizer is able to perform I/O controls at the same time it is outputting synthesized voice data.

In conclusion, the speech synthesizer 30 of the invention has the following advantages over the prior art.

(1) First, the invention allows the speech synthesizer 30 to be capable of performing multi-tasking on external devices 60 and the outputting of the synthesized sound data to sound transducer 41. The drawback of the prior art as mentioned in the background section is therefore eliminated.

(2) The invention allows the speech synthesizer 30 to be constructed with simple software complexity and can be realized by either hardware or software for voice concatenation.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A method to synthesize speech, comprising:

(i) presenting a voice list pointer (VLP) value from a voice list section of a memory unit also having a speech data section, an interrupt vector section, and a control program section;

(ii) from a first speech section, fetching an address corresponding to the VLP value;

(iii) retrieving a first segment of a speech data from the first speech section;

(iv) synthesizing the retrieved speech data into voice data and then broadcasting the synthesized voice data;

(v) generating an interrupt signal when the broadcasting of the synthesized voice data is completed, (v)(a) presenting a synthesis interrupt, and (v)(b) actuating an synthesis interrupt service routine;

(vi) incrementing the VLP to gain access to a next speech section;

(vii) determining whether a stop mark is encountered in the first segment data retrieved from the current speech section;

(viii)(a) if a stop mark is not encountered, repeating the steps (iv) through (viii), (viii)(b) if a stop mark is encountered, terminating the synthesizing operation.

2. The method of claim 1, wherein presenting a VLP value includes generating a VLP value by a VLP register.

3. The method of claim 1, wherein the first segment of speech data are sound waveform data.

4. A method to synthesize speech, comprising:

presenting a memory unit having an interrupt vector section, a voice list section, a control program section, and a speech data section;

generating an address signal to the memory unit;

using the address signal to gain access to a first speech section which contains the address of a corresponding speech data;

retrieving a first segment of the speech data from a location indicated by the first speech section;

synthesizing the retrieved first segment speech data into voice data and then broadcasting the synthesized voice data;

generating an interrupt signal when the broadcasting of the synthesized voice data is completed, providing a synthesis interrupt, and actuating a synthesis interrupt service routine;

gaining access to a next speech section; and synthesizing each retrieved next speech data into voice data until a stop mark is encountered.

5. The method of claim 4, wherein the memory unit is a read only memory unit.

6. The method of claim 4, wherein the address of each speech section is indicated by a voice list pointer value.

7. A speech synthesizer, comprising:

a memory unit having an interrupt vector section, a voice list section, a control program section, and a speech data section, each section having data stored therein;

a voice list pointer having a value that represents an address in the voice list section of the memory unit to gain access to the data stored at the specified address in the voice list section of the memory unit;

a start address register having content that represents a starting address of a specific chunk of speech data stored in the speech data section of the memory unit;

a program counter having an output that is used to gain access to specific addresses in the control program section of the memory unit;

a synthesizer to synthesize the retrieved speech data from the memory unit into voice data; and an interrupt controller that is adapted to actuate the execution of a synthesis interrupt service routine stored in the memory unit in response to an interrupt signal generated by the synthesizer.

8. The speech synthesizer of claim 7, further comprising:

a multiplexer selectively coupling an output of the voice list pointer, an output of the start address register, and the output of the program counter, to the memory unit so as to gain access to the memory unit accordingly.

9. The speech synthesizer of claim 7, further comprising:

a stack register coupled to the program counter to store the return address of an interrupt/call operation.

10. The speech synthesizer of claim 7, further comprising:

a digital to analog converter coupled to the synthesizer to convert a digital output of the synthesizer into an analog waveform.

11. The speech synthesizer of claim 7, further comprising:

an input-output controller to control an external device in response to instructions from the memory unit.

12. The speech synthesizer of claim 11, wherein the external device is a motor.

13. The speech synthesizer of claim 11, wherein the external device is a light emitting diode.

14. The speech synthesizer of claim 7, further comprising:

a sound transducer coupled to the synthesizer through a digital to analog converter to convert the output of the digital to analog converter into an audible form.

15. The speech synthesizer of claim 14, wherein the sound transducer is a loudspeaker.

16. The speech synthesizer of claim 7, wherein the memory unit is a read only memory unit.

* * * * *

UNITED STATES PATENT AND TRADEMARK OFFICE

CERTIFICATE OF CORRECTION

PATENT NO. : 6,240,390 B1
DATED : May 29, 2001
INVENTOR(S) : Jih

It is certified that error appears in the above-identified patent and that said Letters Patent is hereby corrected as shown below:

Column 2,
Line 45, after "devices" and insert -- 28 --.

Column 6,
Line 53, delete "data is synthesized" and insert -- data first segment is synthesized --.

Signed and Sealed this

Sixteenth Day of April, 2002

*Attest:*

*Attesting Officer*

JAMES E. ROGAN
*Director of the United States Patent and Trademark Office*